US006262529B1

(12) United States Patent
Semeria et al.

(10) Patent No.: US 6,262,529 B1
(45) Date of Patent: Jul. 17, 2001

(54) DISPLAY SCREEN FREE FROM SCREEN PATTERN

(75) Inventors: Marie-Noëlle Semeria, Nizier du Douchevutte; Philippe Rommeveaux, Coublevie, both of (FR)

(73) Assignees: Commissariat a l'Energie Atomique, Paris; Pixtech, Rousset, both of (FR)

( * ) Notice: Subject to any disclaimer, the term of this patent is extended or adjusted under 35 U.S.C. 154(b) by 0 days.

(21) Appl. No.: 09/380,603

(22) PCT Filed: Mar. 12, 1998

(86) PCT No.: PCT/FR98/00507

§ 371 Date: Sep. 14, 1999

§ 102(e) Date: Sep. 14, 1999

(87) PCT Pub. No.: WO98/42005

PCT Pub. Date: Sep. 24, 1998

(30) Foreign Application Priority Data

Mar. 14, 1997 (FR) ..... 97 03103

(51) Int. Cl.[7] ..... H01J 63/04

(52) U.S. Cl. ..... 313/495; 313/309

(58) Field of Search ..... 313/491, 584, 313/495, 309, 336, 351, 461

*Primary Examiner*—Vip Patel

(74) *Attorney, Agent, or Firm*—Oblon, Spivak, McClelland, Maier & Neustadt, P.C.

(57) ABSTRACT

A display screen which does not have moire effects. The transparency of an intermediate subassembly, through which the observation is made, is substantially constant at the scale of an anode subassembly. The patterns of the intermediate subassemblies have a sufficiently low periodicity in at least one direction. This may be used in the production of display screens with micropoints.

11 Claims, 6 Drawing Sheets

DISPLAY SCREEN FREE FROM SCREEN PATTERN

BACKGROUND OF THE INVENTION

1. Field of the Invention

The object of the present invention is a display screen without moire effect. It finds an application in the production of any display devices, notably with micropoints, also referred to as the field emission display type (or FED for short).

"Without" moire effect means a moire effect which is sufficiently attenuated so as not to be visible to an observer.

2. Discussion of the Background

Although the invention is not limited to this type of display, it is in the case of field emission display screens that the state of the art will be described.

A field emission display screen is described notably in the document FR 2 623 013. The essentials of this device are depicted in the accompanying FIGS. 1 and 2.

The device depicted in these figures comprises, on a substrate 2, for example made of glass, a thin layer of silica 4 and, on this layer, a plurality of electrodes 5 in the form of parallel conductive bands fulfilling the role of cathodic conductors and constituting addressing columns.

These cathodic conductors are covered with a continuous resistive layer 7 (except on the ends to allow the connection of the cathodic conductors with biasing means 20). An electrically insulating layer 8, made of silica, covers the resistive layer 7.

Above the insulating layer 8 there are formed a plurality of electrodes 10 also in the form of parallel conductive bands. These electrodes 10 are perpendicular to the electrodes 5 and fulfill the role of a grid constituting the addressing lines.

The device also has a plurality of elementary emitters of electrons (micropoints), only one example of which (for reasons of simplification) is depicted schematically in FIG. 2: in each of the intersection areas (corresponding to an image point or pixel) cathodic conductors 5 and grids 10, the resistive layer 7 corresponding to this area supports micropoints 12, for example made of molybdenum, and the grid 10 corresponding to the said area has an opening 14 opposite each of the micropoints 12. Each of the latter adopts substantially the shape of a cone whose base rests generally on the layer 7 and whose apex is situated level with the corresponding opening 14. Naturally, the insulating layer 8 is also provided with openings 15 allowing passage of the micropoints 12.

This first subassembly defined by the area of intersection of the cathodic conductors and grid conductors 10, possibly associated with other elements, for example a supplementary grid within the screen or a filter on the face of the screen observed, can be referred to as an "intermediate subassembly".

Thus each intermediate subassembly corresponds to a pixel. Opposite this intermediate subassembly, there is a substrate 30 covered with a conductive layer 32 serving as an anode. This layer is covered with a layer or bands of luminescent materials 34. Hereinafter the emissive part opposite the pixel (or intermediate subassembly) will be referred to as the "anode subassembly".

In the case of a monochrome screen, or an unswitched three-color screen, the size of the anode subassembly corresponds to that of the intermediate subassembly. In the case of a switched three-color screen, the pixel is opposite three bands of luminescent materials, only one of which emits at a time, and the anode subassembly corresponds to the excited band part.

The light emitted by the luminous materials under the impact of the electrons emitted by the micropoints is received by the observer 0. In the usual case, the observation takes place on the anode side, and therefore through the anode subassembly, on the side opposite the excitation of the luminescent materials. However, the major part of the light being emitted on the excitation side, the result is that it is highly advantageous to observe this screen on the excitation side of the luminescent materials, and therefore through the intermediate subassembly which, because of this, must be at least partially transparent. This operating mode is all the more advantageous since the entire quantity of light emitted can be reflected towards the intermediate subassembly by the use of a reflective layer disposed behind the luminescent materials (this layer can be the anode itself or a supplementary layer, for example of aluminium). In addition, as the intermediate subassembly is partially transparent, it fulfills the role of a neutral filter and thus reduces the effects related to diffuse reflection, in the case notably where the luminescent materials are powder luminophores.

The intermediate subassembly defined by the intersection of an addressing row and column can take various forms. In one embodiment described in the document FR-A-2 687 839, the cathodic conductors have a lattice structure and the grid conductors a perforated structure. This embodiment is illustrated in FIGS. 3A and 3B, which are respectively plan and cross-sectional views.

In these figures, the cathodic conductors bear the reference 5*a* and the grid conductors the reference 10*g*. The grids have openings 11 opposite the areas of intersection of the conductive tracks 5*a* and are centered on these areas, as can be seen in FIG. 3A. Naturally, the grids also have holes 14*a* respectively opposite the micropoints 12.

More precisely, each grid 10*g* has substantially the structure of a lattice identical to the lattice of the corresponding cathodic conductor, but the lattice of this grid is offset, with respect to the lattice of the cathodic conductor, by a half-pitch parallel to the addressing rows and a half-pitch parallel to the addressing columns. Above an area where micropoints are collected, this grid has, in plan view, a square surface 10*a* which has holes 14*a* in it and at which there end four tracks 10*b* forming part of the lattice of this grid.

Many other embodiments are possible, but it will be understood that the intermediate subassembly, through which the observation is effected, though it is semi-transparent overall, is, in reality, formed by highly diverse areas if it is examined on a small scale. Each pixel defined by the overlapping of an addressing row and column therefore comprises a central area (which will be referred to as the "pupil" of the pixel) and four lateral half-parts. The four lateral parts separate each area from its four neighbours. Each pixel therefore has an optical transmission which is not uniform. FIG. 4 shows the appearance of such a pixel, where the central part 40 can be discerned, with its repetitive subassemblies corresponding to the meshing of the grid conductor and of the cathode conductor, and the lateral parts 42*a*, 42*b*, 42*c*, 42*d*.

This complex periodic structure of the intermediate subassembly, superimposed on the structure, also periodic, of the anode subassembly (in terms of emission as previously defined) can lead to display defects due to moire effects. These defects are illustrated in FIGS. 5*a* and 5*b*, on the one hand, and in FIG. 6 on the other hand.

FIGS. 5A and 5B, first of all, correspond to the case where the intermediate subassembly and the anode subassembly are not strictly aligned. This appears when there are several bands of luminescent materials (three-color screen, switched or otherwise). It is assumed that the columns of luminescent materials disposed on the anode are not strictly parallel to the addressing columns of the intermediate subassembly. FIGS. 5A and 5B are sections along a plane perpendicular to the columns, at two different points on the screen (for example at the top and at the bottom).

In these two figures, the intermediate subassembly bears the general reference 50 and is depicted schematically with regions 52 corresponding to the central part of the pixels, relatively transparent areas, and half-regions 54 corresponding to the lateral half-areas, less transparent; the anode subassembly is depicted in the form of the emissive luminous band 62.

FIGS. 5A and 5B depict, by way of example, the case of a three-color screen, switched or otherwise.

Since the light is not transmitted from the luminescent bands to the observer in the same way from one end of the column to the other, the image perceived will be interfered with by lines or fringes which are more or less bright and coloured. This moire effect is a nuisance to the observer.

FIG. 6 also shows, in the case of both a monochrome screen and a three-color screen, switched or otherwise, that the light flux emitted by an anode subassembly 62 is not strictly the same in the direction of an observer 70 facing the subassembly 62 and in the direction of an observer 72 placed to the side, whatever the direction of the movement.

The variations in transparency on the pixel scale and on the scale of each anode subassembly therefore gives rise to parasitic effects, which impair the quality of the displayed image.

The aim of the present invention is precisely to remedy these drawbacks.

SUMMARY OF THE INVENTION

As has been seen, the intermediate subassembly necessarily has patterns with more or less complex shapes (meshes, lattices etc) so that local variations in transparency, within one and the same pixel, cannot be avoided. However, the invention considers that what matters above all, for the observer, is the total transparency of the intermediate subassembly for a given anode subassembly. However, anode subassemblies always have dimensions which are smaller than (or at most equal to) the dimensions of a pixel. Thus, for example, for three-color screens with switched anode, the anode subassemblies are smaller than the pixels. They are of the same size only with monochrome screens, or with unswitched three-color screens.

Starting from this remark, the invention recommends giving the various subassemblies of the intermediate subassembly shapes and optical properties such that the mean transparency, taken on the scale of an anode subassembly, is substantially constant over the entire surface of the intermediate subassembly. In other words, the intensity of the light transmitted by the intermediate subassembly, coming from an anode subassembly, must remain substantially constant whatever the relative position of the anode subassembly with respect to the intermediate subassembly.

"Substantially constant" means that the quantity under consideration (transparency, transmitted intensity) varies by less than 10% when the intermediate subassembly is swept. Preferably, this quantity varies by less than 5%.

In other words, the invention recommends homogeneity of transmission of the intermediate subassembly on a particular scale, which is that of the anode subassembly.

In precise terms, the object of the present invention is therefore a display screen comprising:

addressing rows and columns defining, at their overlaps, a matrix of pixels, these pixels corresponding to first subassemblies referred to as intermediate subassemblies, these intermediate subassemblies having repetitive transparent areas produced in the rows and/or columns;

second subassemblies, referred to as anode subassemblies, each comprising a luminescent part, at least one anode subassembly being disposed opposite an intermediate subassembly and being able to be observed by transparency through the intermediate subassemblies;

this screen being characterised by the fact that the intermediate subassemblies have, over the entire surface corresponding to the geometry of an anode subassembly, a mean transparency which is substantially constant whatever the position of this surface.

Preferably, the mean transparency of each intermediate subassembly is constant to within 10%.

According to a first embodiment, the elementary subassemblies of the pixels are repeated according to a first pitch along a first direction and according to a second pitch along a second direction, the second pitch being less than the first and being equal to a fraction of the dimension of the anode subassemblies along this second direction.

Preferably, the said fraction is between $1/8$ and $1/20$ and, for example, around $1/10$.

In a second embodiment, the elementary subassemblies of the pixels are repeated according to a first pitch along a first direction and according to a second pitch along a second direction, these first and second directions being inclined with respect to the addressing rows and columns.

Preferably, the first and second directions are inclined at 45° with respect to the addressing rows and columns.

Preferably also, the first and/or second pitches are equal to a fraction of the dimensions of the anode subassemblies. This fraction can be between $1/5$ and $1/8$.

The patterns of the intermediate subassembly are determined, according to one advantageous mode, by an iterative modeling, until a mean transmission of the intermediate subassembly is obtained which is substantially constant, whatever the position of the anode subassembly (on the scale of the latter). For this purpose, it is possible to use, for example, a spreadsheet comprising a first series of inputs for introducing transmission characteristics of the patterns of an intermediate subassembly. In this way a first meshing of the intermediate subassembly is effected. This spreadsheet has a second series of inputs for introducing characteristics of positioning of the anode subassembly with respect to the intermediate subassembly. In this way a second meshing of the anode subassembly is effected. Then the two meshings are superimposed for different relative positions of the anode subassembly with respect to the intermediate subassembly and, for each position, the transmission obtained is watched. This step corresponds to a mathematical convolution of the anode subassembly by means of any part of the intermediate subassembly. If the transmission is not sufficiently constant, then the patterns of the intermediate subassembly are modified and the process is reiterated.

In an arrangement corresponding to a color display, three anode subassemblies are opposite an intermediate subassembly.

DETAILED DESCRIPTION OF THE PREFERRED EMBODIMENTS

Figure 1:
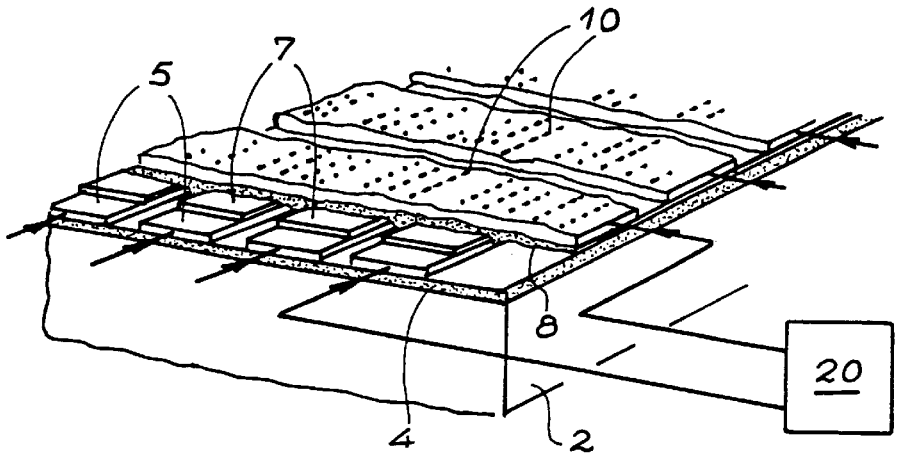
FIG. 1, already described, shows schematically a first known addressing subassembly.
Figure 2:
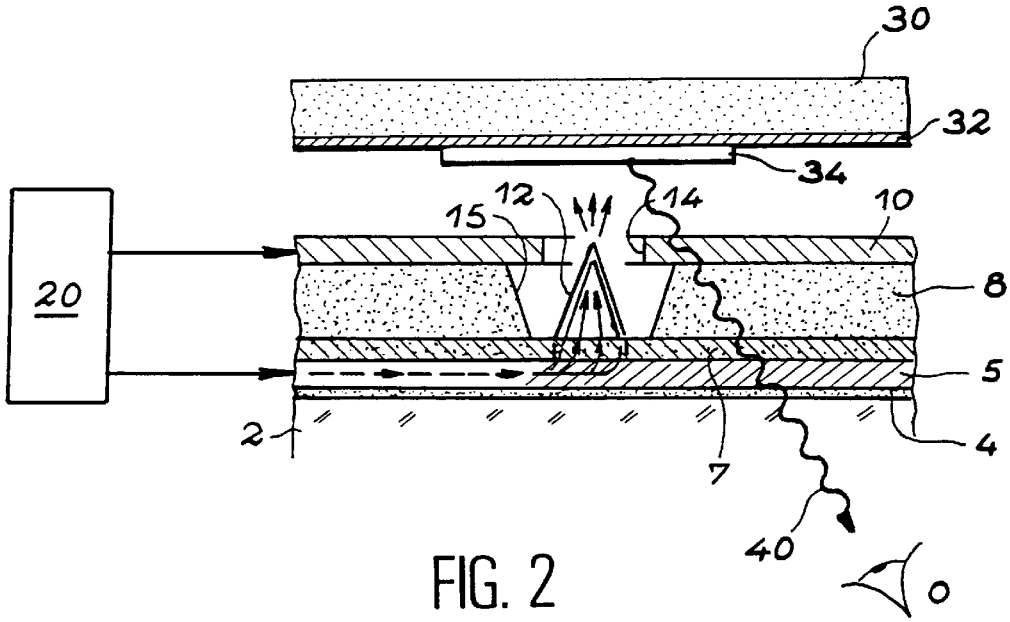
FIG. 2, already described, shows schematically and in section an emissive point and a luminescent screen.
Figure 3A:
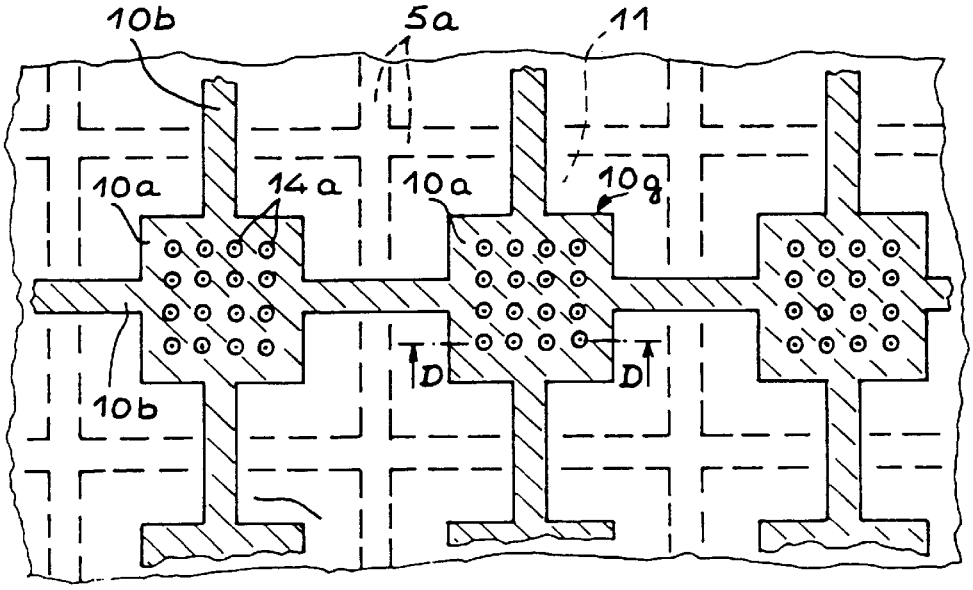
FIGS. 3A and 3B, already described, show a meshed subassembly, respectively in plan view and in section.
Figure 3B:
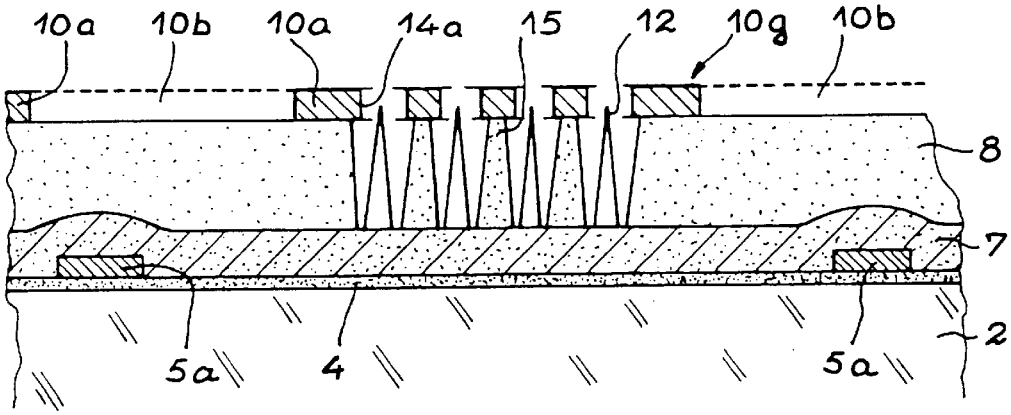
Figure 4:
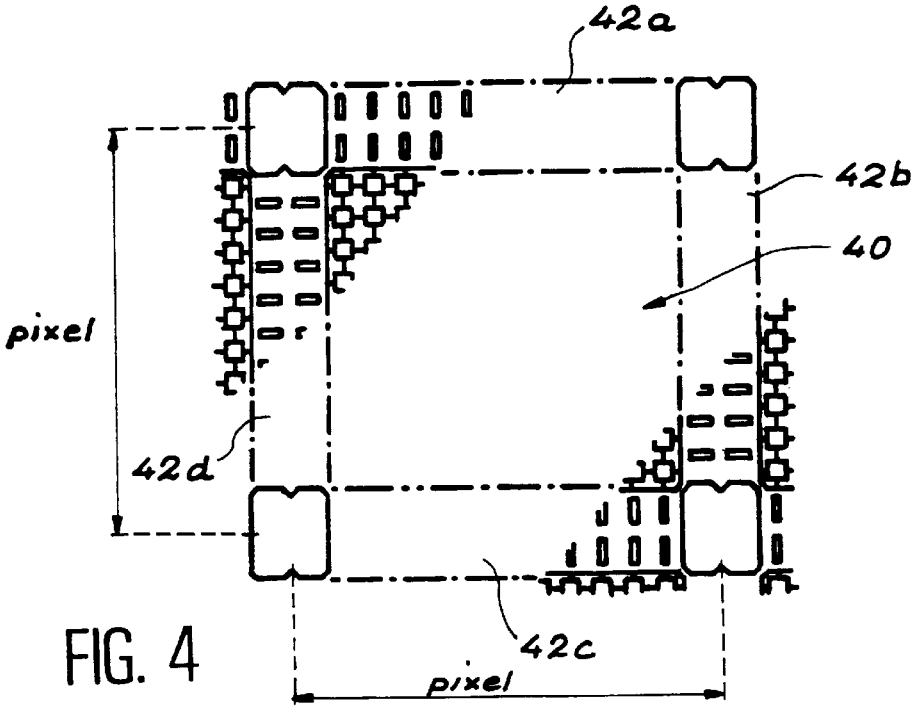
FIG. 4, already described, illustrates the differences in transparency within a pixel.
Figure 6:
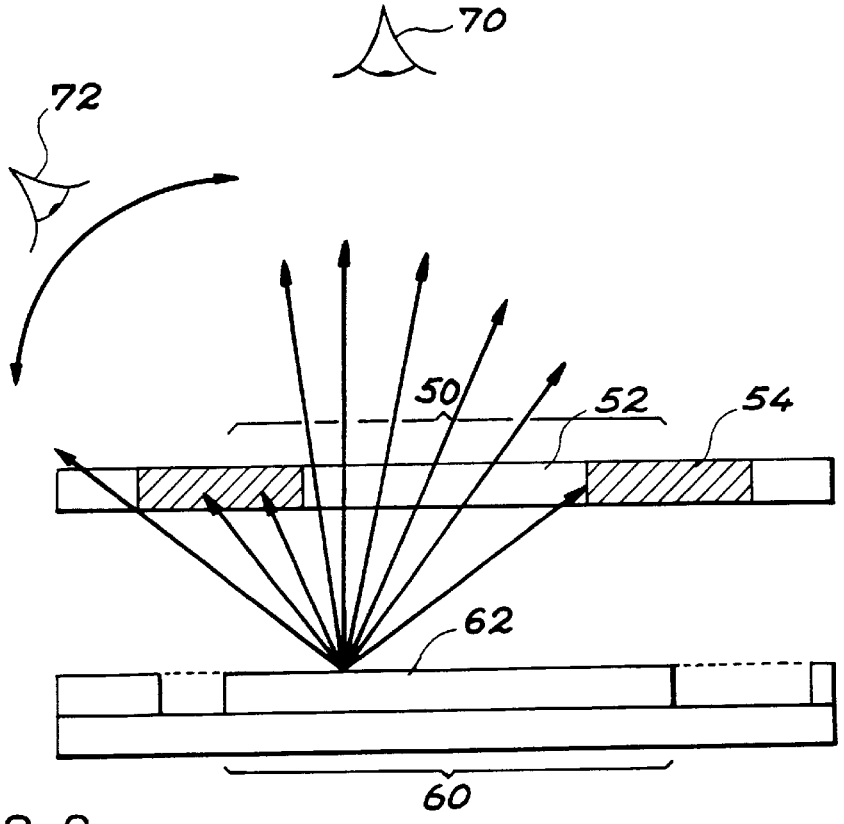
FIG. 6, already described, illustrates the similar harmful effects according to the different relative positions of the observer.
Figure 5A:
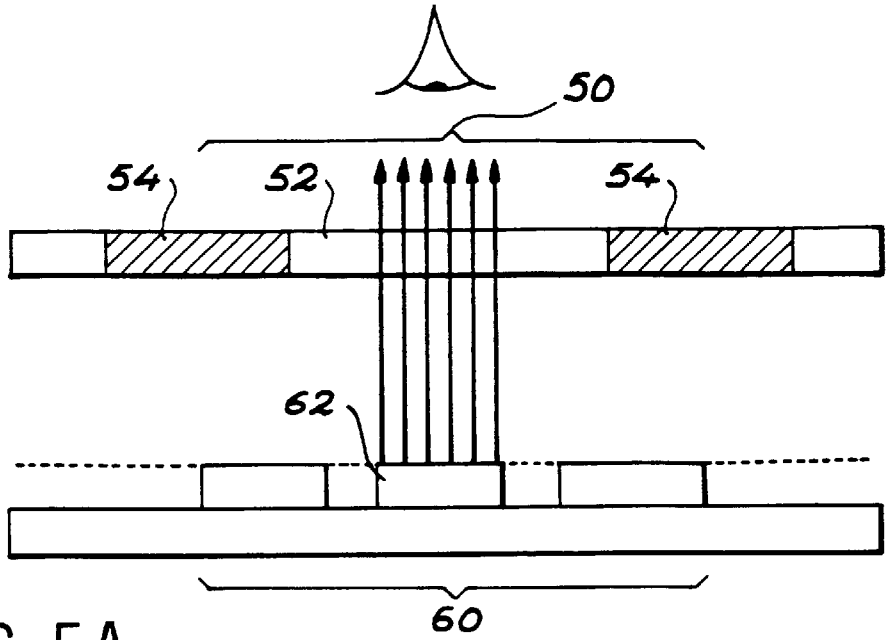
FIGS. 5A and 5B, already described, illustrate the harmful effects of the known structures in the event of misalignment of the bands of luminescent materials and addressing columns.
Figure 5B:
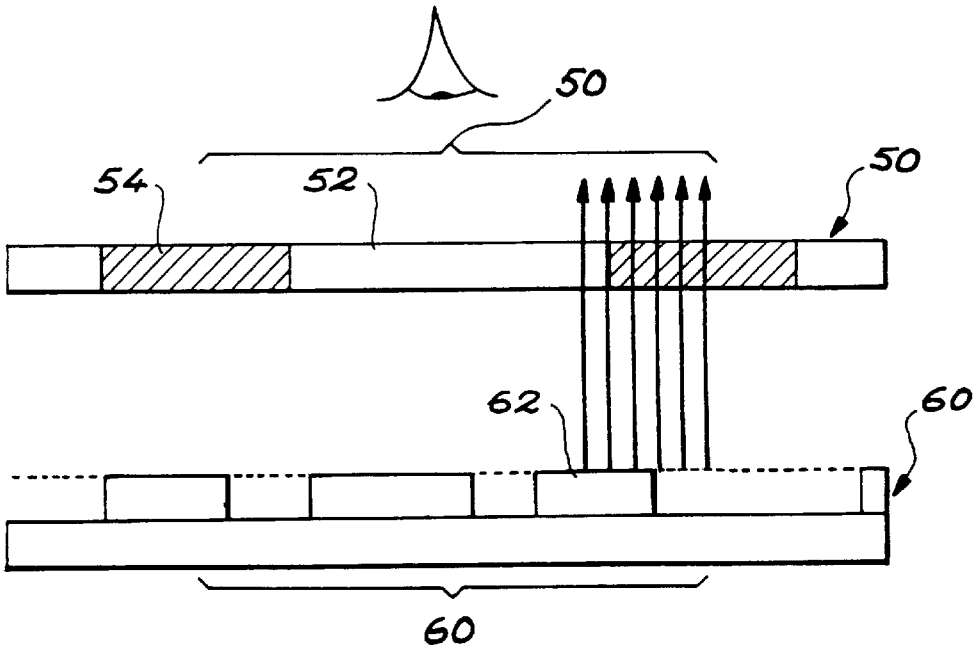
Figure 7:
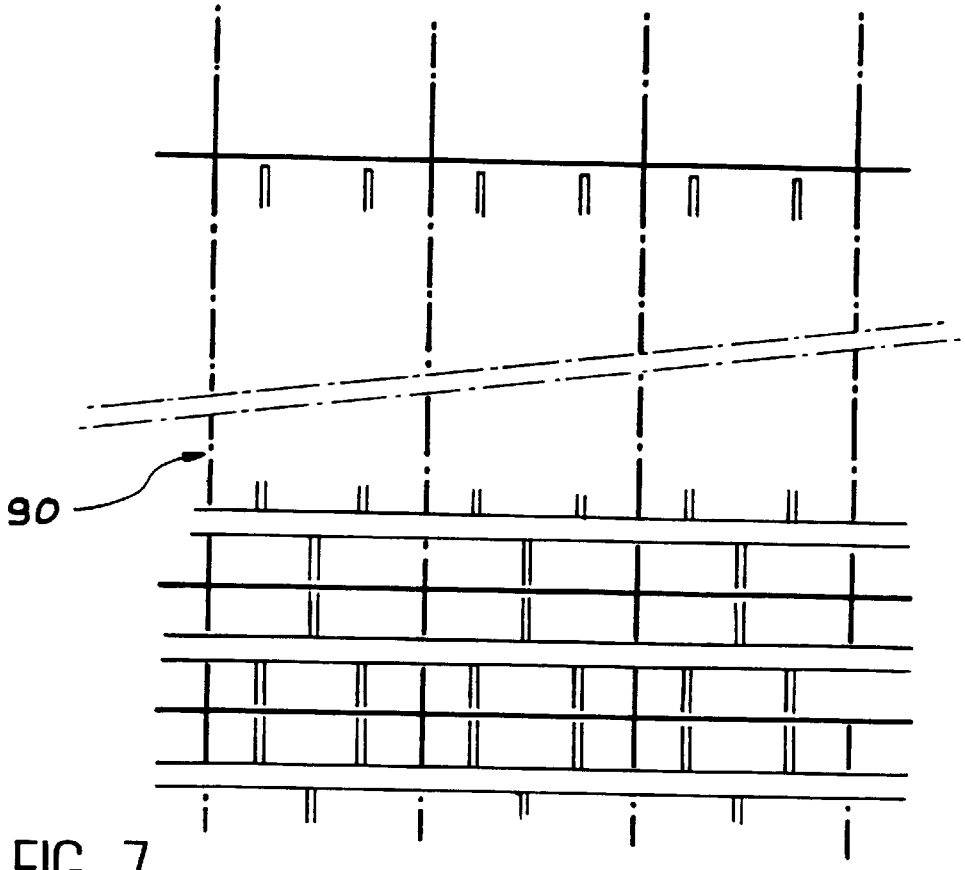
FIG. 7 illustrates, in plan view, a first embodiment of the invention with subassemblies elongated along the rows.
Figure 8:
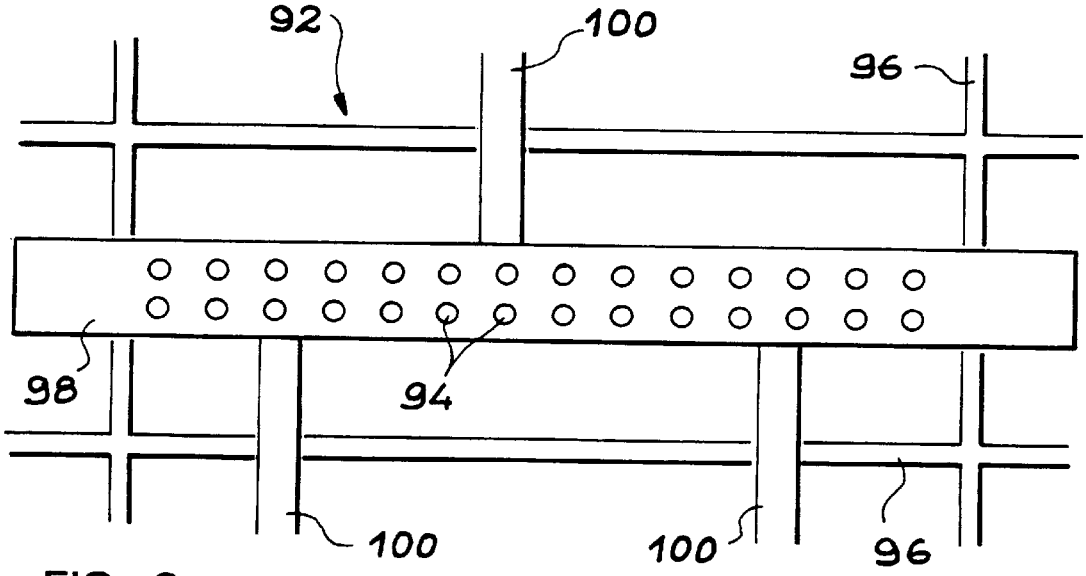
FIG. 8 shows schematically such an elongated subassembly.

FIGS. 7 and 8 illustrate a first embodiment in which the small period required for the patterns of the intermediate subassembly is obtained in a single direction, for example that of the columns. These patterns therefore have a double periodicity, with a shape elongated along the rows.

FIG. 7 shows, in plan view, an addressing element 90 with elongated subassemblies 92. This subassembly is detailed in FIG. 8. The micropoints 94 are connected to a cathodic conductor 96 in the form of a lattice. The grid controlling the emission has the shape of a conductive band 98 connected to conductors 100. Each pattern of the intermediate subassembly therefore has the appearance of an elongate rectangle delimited by the cathodic conductors 96 and barred at its center by the grid 98. The length of this rectangle can be equal to one third of the width of a pixel and the width to one tenth. This small period in the direction of the columns shows homogeneity of the required transparency.

It will also be observed, as can be seen in FIG. 7, that the elementary pattern extends into the lateral half-areas of the pixel.

If there is disposed, behind the subassembly obtained by repetition of the element of FIG. 7, an emissive anode rectangle with dimensions less than or equal to those of the pixel and if one is moved with respect to the other, the emission obtained through the subassembly will be substantially constant over the entire surface of the intermediate subassembly and the moire effect will disappear.

Figure 9:
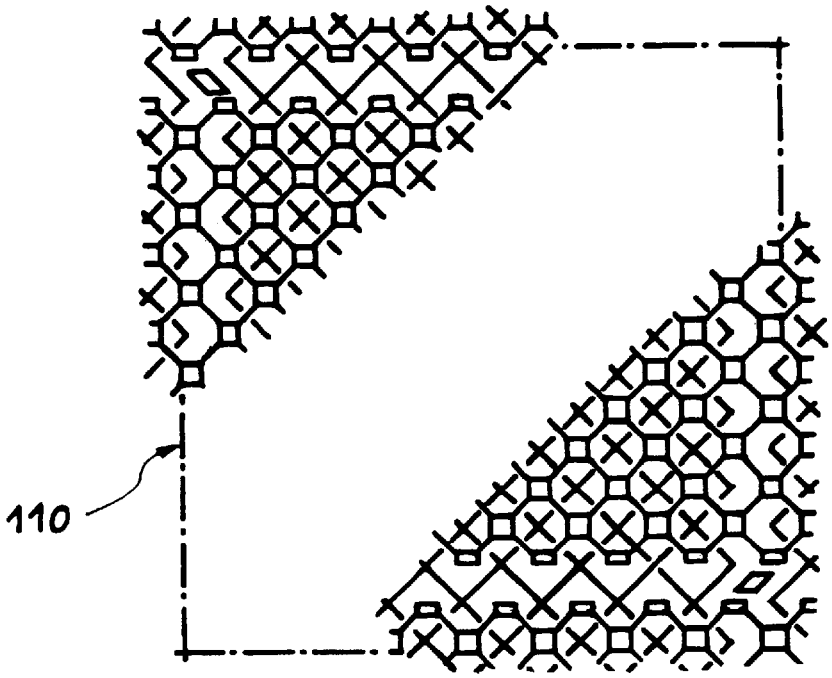
FIG. 9 illustrates, in plan view, a second embodiment with subassemblies inclined at 45° to the addressing rows and columns.
Figure 10:
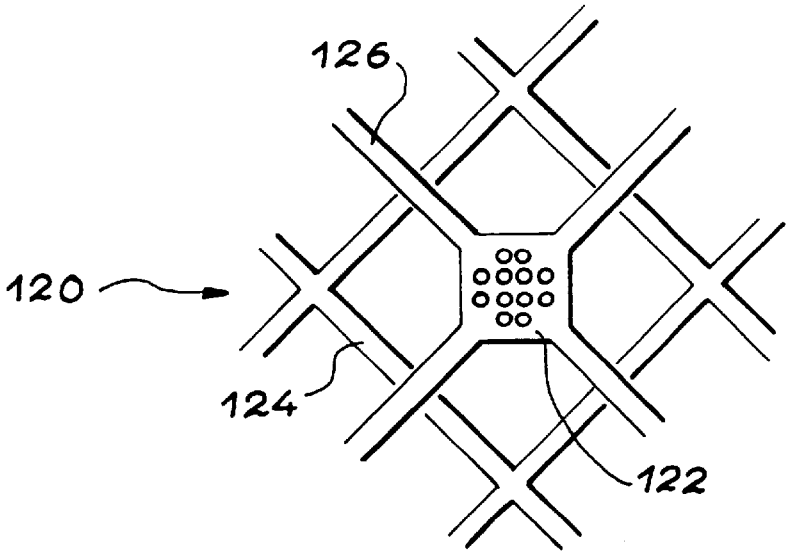
FIG. 10 shows in more detail a subassembly inclined at 45°.

FIGS. 9 and 10 illustrate a second embodiment in which the periodicity is the same in the two orthogonal directions, the latter being oriented at 45° to the addressing rows and columns. FIG. 9 shows a pixel in plan view and FIG. 10 a pattern 120 with its micropoints 122, its cathodic conductors 124 and its grid conductors 126.

The double periodicity can correspond to a pitch of around ⅕ to ⅛ of the dimensions of the luminescent anode subassembly.

What is claimed is:

1. A display screen comprising:

addressing rows and columns defining, at their overlaps, a matrix of pixels, these pixels corresponding to first subassemblies referred to as intermediate subassemblies, these intermediate subassemblies having repetitive transparent areas produced in the rows and/or columns;

second subassemblies, referred to as anode subassemblies, each comprising a luminescent part, at least one anode subassembly being disposed opposite an intermediate subassembly and being able to be observed by transparency through the intermediate subassemblies;

this screen being characterised by the fact that each intermediate subassembly comprises elementary patterns which are repeated according to a first pitch along a first direction and according to a second pitch along a second direction, the second pitch being less than the first and being equal to a fraction of the dimension of an anode subassembly along this second direction.

2. A display screen according to claim 1, wherein said fraction is between ⅛ and 1/20.

3. A display screen according to claim 1, wherein the first direction is parallel to the addressing rows.

4. A display screen according to claim 1, wherein the first and second directions are inclined with respect to the addressing rows and columns.

5. A display screen according to claim 4, wherein the first and second directions are inclined at 45° with respect to the addressing rows and columns.

6. A display screen according to claim 4, wherein the first and second pitches are equal to a fraction of the dimensions of the anode subassemblies.

7. A display screen according to claim 6, wherein the fraction is between ⅕ and ⅛.

8. A display screen according to claim 1, wherein the screen is of the micropoint type.

9. A display screen according to claim 1, wherein the patterns of the intermediate subassembly are determined by iterative modeling.

10. A display screen according to claim 9, wherein the iterative modeling is achieved by superimposition of an intermediate subassembly and an anode subassembly, by determination of the transmission obtained for different relative positions of the two subassemblies, and by modification of the intermediate subassembly until the required transparency is obtained.

11. A display screen as claimed in claim 1, wherein three anode subassemblies are opposite an intermediate subassembly.

* * * * *